US008430502B2

(12) United States Patent
Mizutani

(10) Patent No.: US 8,430,502 B2
(45) Date of Patent: Apr. 30, 2013

(54) PRINTING DEVICE AND COMPUTER PROGRAM PRODUCT FOR USE IN PRINTING DEVICE

(75) Inventor: Shunsuke Mizutani, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 747 days.

(21) Appl. No.: 12/556,554

(22) Filed: Sep. 9, 2009

(65) Prior Publication Data

US 2010/0141700 A1 Jun. 10, 2010

(30) Foreign Application Priority Data

Sep. 26, 2008 (JP) ..... 2008-247171

(51) Int. Cl.
*B41J 29/38* (2006.01)
*B41J 2/01* (2006.01)

(52) U.S. Cl.
USPC ..... 347/104; 347/16

(58) Field of Classification Search ..... 347/16, 347/104
See application file for complete search history.

(56) References Cited

U.S. PATENT DOCUMENTS

2004/0179053 A1* 9/2004 Itoh ..... 347/16
2005/0253886 A1* 11/2005 Nakajima et al. ..... 347/16
2006/0087547 A1 4/2006 Yasui et al.
2006/0238594 A1 10/2006 Tham et al.
2008/0068632 A1 3/2008 Fukasawa

FOREIGN PATENT DOCUMENTS

JP 2004-224057 A 8/2004
JP 2004-276264 A 10/2004
JP 2008-080808 A 4/2008

OTHER PUBLICATIONS

European Patent Office, European Search Report for European Patent Application No. 09252193.9, dated Jan. 7, 2011.
Japan Patent Office, Notice of Reasons for Rejection for Japanese Patent Application No. 2008-247171, mailed Jul. 20, 2010.

* cited by examiner

*Primary Examiner* — Ryan Lepisto
*Assistant Examiner* — Erin Chiem
(74) *Attorney, Agent, or Firm* — Baker Botts L.L.P.

(57) ABSTRACT

A printing device configured to operate selectively in one of a single-sided printing mode and a double-sided printing mode comprises a printing unit configured to eject ink, and a controller. When the printing device operates in the double-sided printing mode, the controller is configured to calculate a drying time for a front-side image printed by the printing unit on a front side of a sheet, and to determine whether the calculated drying time exceeds a predetermined threshold value. When the controller determines that the drying time dose not exceed the predetermined threshold value, the controller is configured to control the printing unit to print a back-side image on a back side of the sheet. When the controller determines that the drying time exceeds the predetermined threshold value, the controller is configured to control the printing unit not to print the back-side image on the back side of the sheet, and to print the back-side image on a front side of a next sheet.

15 Claims, 5 Drawing Sheets

Fig.4 (PROCESSING IN MFP)
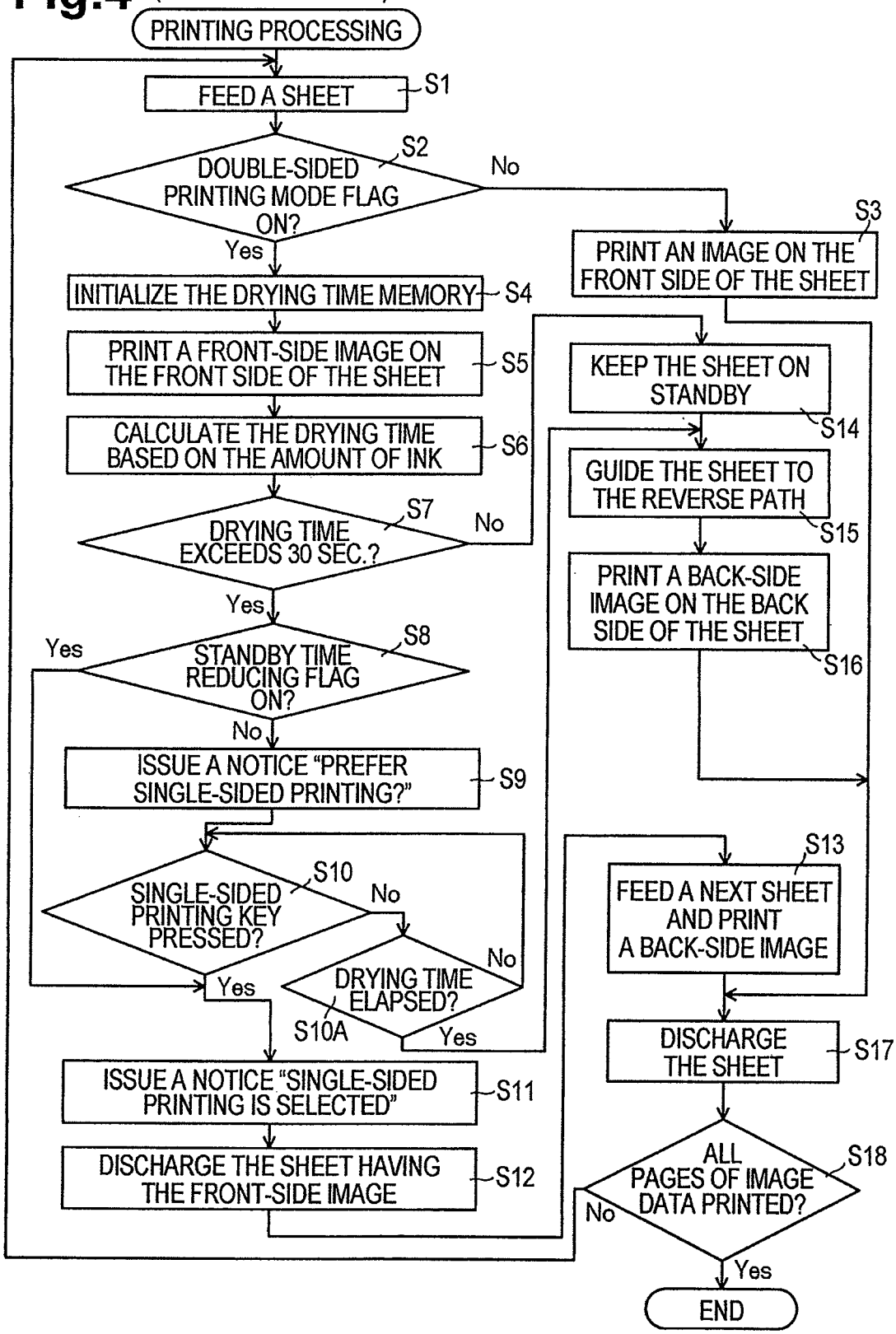

Fig.5 (PROCESSING IN MFP)
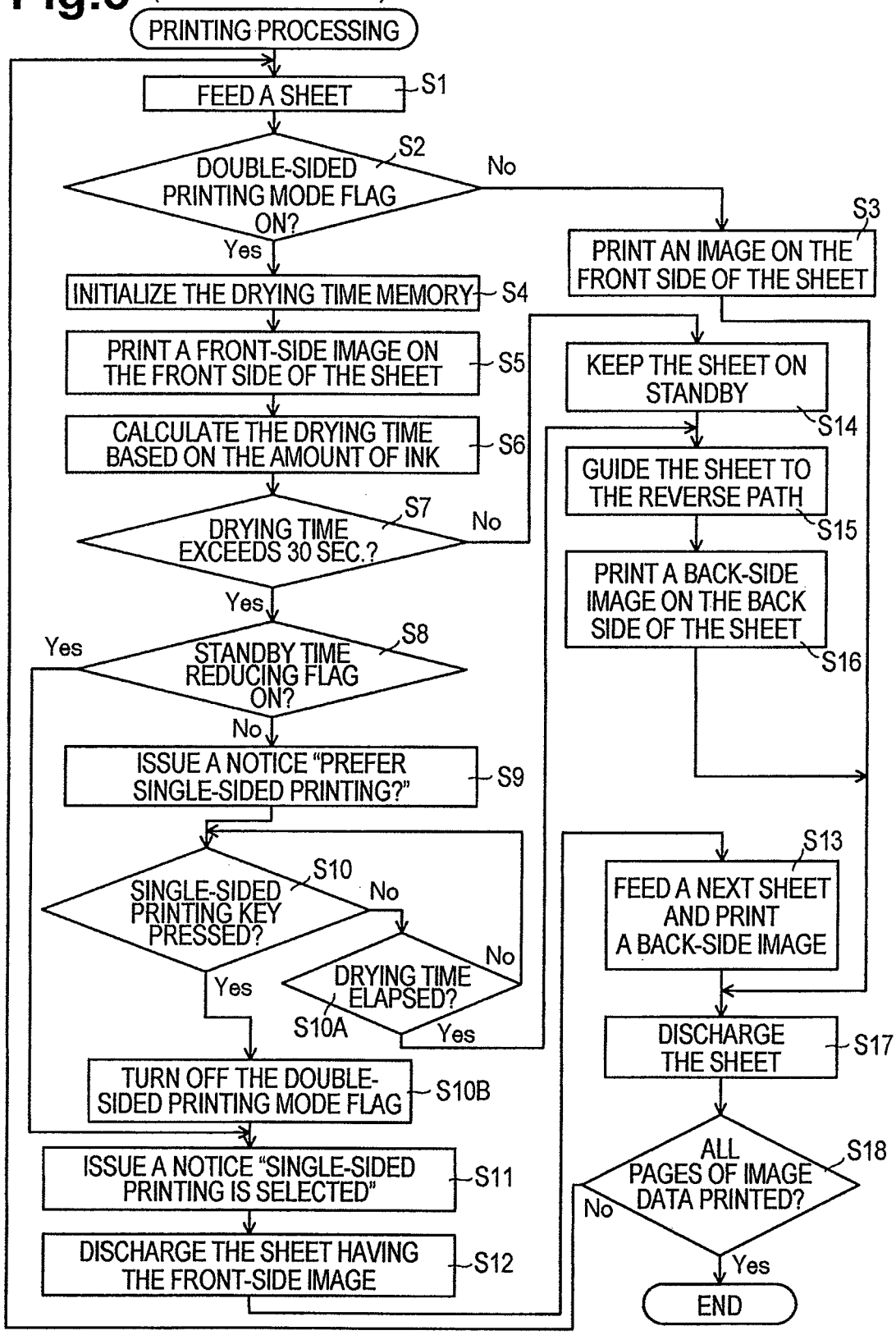

PRINTING DEVICE AND COMPUTER PROGRAM PRODUCT FOR USE IN PRINTING DEVICE

CROSS-REFERENCE TO RELATED APPLICATION

The present application claims priority from Japanese Patent Application No. JP-2008-247171, which was filed on Sep. 26, 2008, the disclosure of which is incorporated herein by reference in its entirety.

BACKGROUND OF THE INVENTION

1. Field of the Invention

The invention relates to a printing device and a computer program product for use in a printing device.

2. Description of Related Art

A known printing device, e.g., an inkjet printer, is configured to print an image on one side of a sheet of recording medium and keeps the sheet in a standby state for a predetermined time depending on the amount of ink ejected onto the one side of the sheet. Then, the printing device conveys the sheet and prints an image on the other side of the sheet.

In the known printing device, the sheet is kept in a standby state for the predetermined time after the printing device prints an image on one side of the sheet. Thus, it may take a relatively long time for the printing device to finish printing on both sides of the sheet, and a user may have to wait for a relatively long time to get the sheet having an image printed on both sides.

SUMMARY OF THE INVENTION

Therefore, an object of the invention is to provide a printing device which overcomes these and other shortcomings of the related art. A technical advantage of the invention is a reduction in the waiting time for a user until printing on a double-sided printing mode is finished.

According to an embodiment of the invention, a printing device configured to operate selectively in one of a single-sided printing mode for printing on one side of a sheet and in a double-sided printing mode for printing on both sides of a sheet comprises a printing unit configured to eject ink, and a controller. When the printing device operates in the double-sided printing mode, the controller is configured to calculate a drying time for a front-side image printed by the printing unit on a front side of a sheet, and to determine whether the calculated drying time exceeds a predetermined threshold value. When the controller determines that the drying time dose not exceed the predetermined threshold value, the controller is configured to control the printing unit to print a back-side image on a back side of the sheet. When the controller determines that the drying time exceeds the predetermined threshold value, the controller is configured to control the printing unit not to print the back-side image on the back side of the sheet, and to print the back-side image on a front side of a next sheet.

According to another embodiment of the invention, a computer program product, for use in a printing device, comprises a computer usable medium having computer readable instructions stored thereon, and the computer readable instructions are configured to cause a processor to execute the steps of determining whether a double-sided printing mode for printing on both sides of a sheet is designated for a printing device; controlling the printing device to eject ink and print a front-side image on a front side of a sheet; calculating a drying time for the front-side image printed on the front side of the sheet; determining whether the calculated drying time exceeds a predetermined threshold value; controlling the printing device to print a back-side image on a back side of the sheet when the processor determines that the drying time does not exceed the predetermined threshold value; and controlling the printing device not to print the back-side image on a back side of the sheet, and to print the back-side image on a front side of a next sheet, when the processor determines that the calculated drying time exceeds the predetermined threshold value.

Other objects, features, and advantages will be apparent to persons of ordinary skill in the art from the following detailed description of the invention and the accompanying drawings.

BRIEF DESCRIPTION OF THE DRAWINGS

For a more complete understanding of the invention, the needs satisfied thereby, and the features and technical advantages thereof, reference now is made to the following descriptions taken in connection with the accompanying drawings.

FIG. 4 is a flowchart illustrating printing processing performed in the printing device of FIG. 1, according to an embodiment of the invention.

FIG. 5 is a flowchart illustrating printing processing performed in the printing device of FIG. 1, according to another embodiment of the invention.

DETAILED DESCRIPTION OF THE EMBODIMENTS

Embodiments of the invention and their features and technical advantages may be understood by referring to FIGS. 1-4, like numerals being used for like corresponding parts in various drawings.

Figure 1:
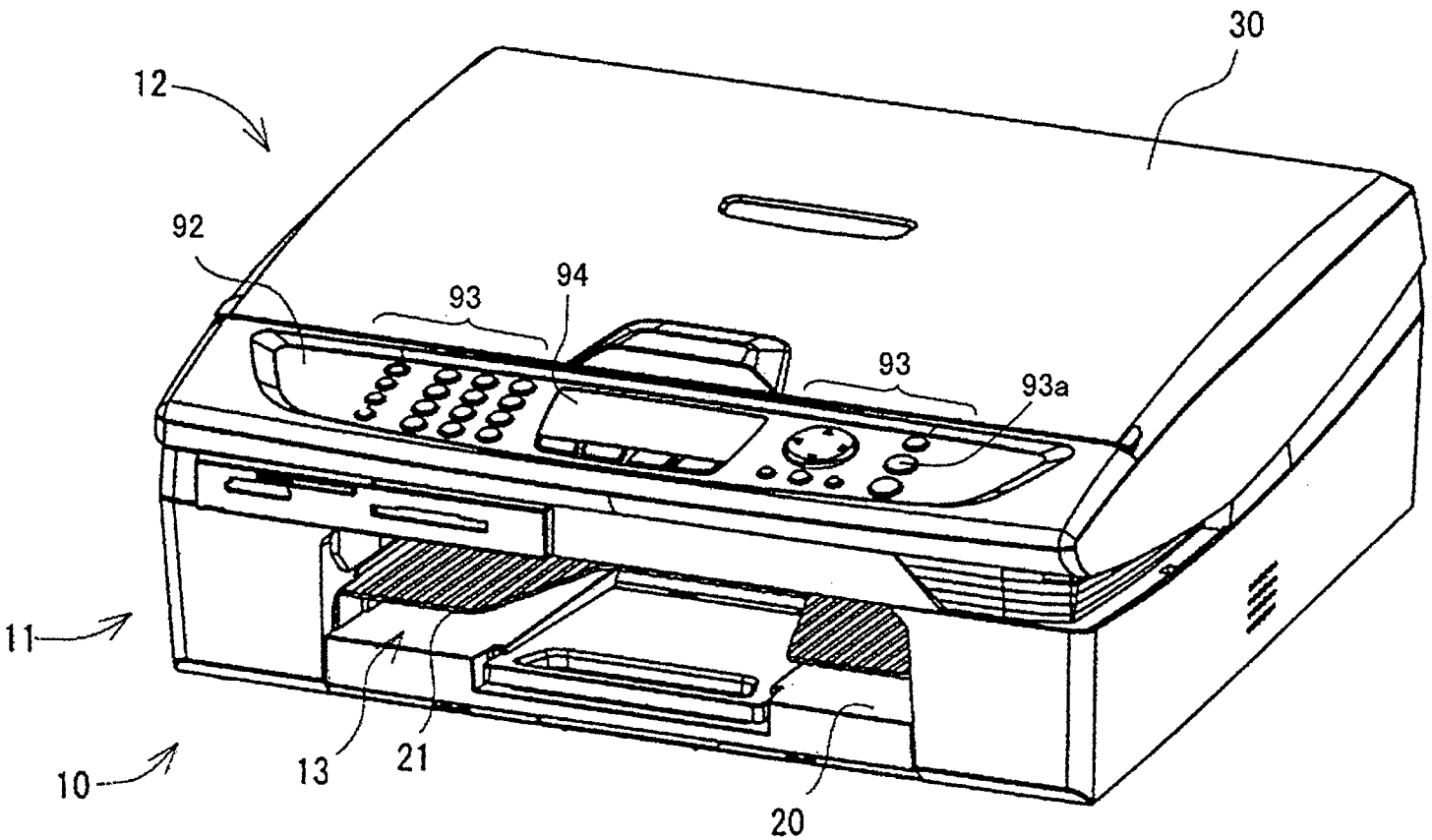
FIG. 1 is a perspective view of a printing device, e.g., a multi-function device, according to an embodiment of the invention.

Referring to FIG. 1, a printing device, e.g., a multi-function device 10, may perform one or more functions, e.g., a printing, copying, scanning, facsimile functions, or any combination thereof.

The multi-function device 10 is configured to print an image by ejecting ink onto a sheet of recording medium and has a single-sided printing mode and a double-sided recording mode. The multi-function device 10 prints an image on one side of a sheet in the single-sided printing mode, and prints an image on both sides of a sheet in the double-sided printing mode.

When the multi-function device 10 operates in the double-sided printing mode, the device 10 is configured to change from double-sided printing to single-sided printing temporarily when a time required for drying an image printed on a front side of a sheet exceeds a predetermined time, e.g., 30 seconds. In this case, instead of printing an image on a back side of the sheet, the multi-function device 10 prints that image on a front side of a next sheet. This reduces the waiting time for a user until printing in the double-sided printing mode is finished.

The multi-function device 10 comprises a printer 11 disposed at a lower portion, a scanner 12 disposed at an upper portion, and an operation panel 92 disposed at an upper front portion of the device 10. The printer 11 has an opening 13 at the front of the device 10. A feed tray 20 and a discharge tray 21 are arranged vertically in two layers in the opening 13 and are partially exposed through the opening 13. The feed tray 20 is configured to store a stack of sheets. A sheet is fed from the feed tray 20 to the inside of the printer 11, and the printer 11 prints an image on the sheet, and then the sheet having an image printed thereon is discharged onto the discharge tray 21.

The scanner 20 may be a flatbed scanner. A document cover 30 serves as a top plate of the multi-function device 10, and a platen glass (not shown) is disposed under the document cover 30. The scanner 12 reads a document placed on the platen glass and covered by the document cover 30.

The operation panel 92 for operating the printer 11 and the scanner 12 comprises operation keys 93 and a LCD (liquid crystal display) 94. The operation keys 93 comprise a single-sided printing key 93*a* and other keys. When a drying time required for an image printed on a front side of a sheet exceeds a predetermined time, e.g., 30 seconds, the single-sided printing key 93*a* is used to select whether to change the printer 11 from double-sided printing to single-sided printing or keep the printer 11 continuing double-sided printing. The operation panel 92 allows a user to perform various settings and operations, e.g., setting of the type of sheet (plain paper, postcard, etc.), the printing mode (single-sided printing mode or double-sided printing mode), and the resolution (draft mode or photo mode).

Figure 2:
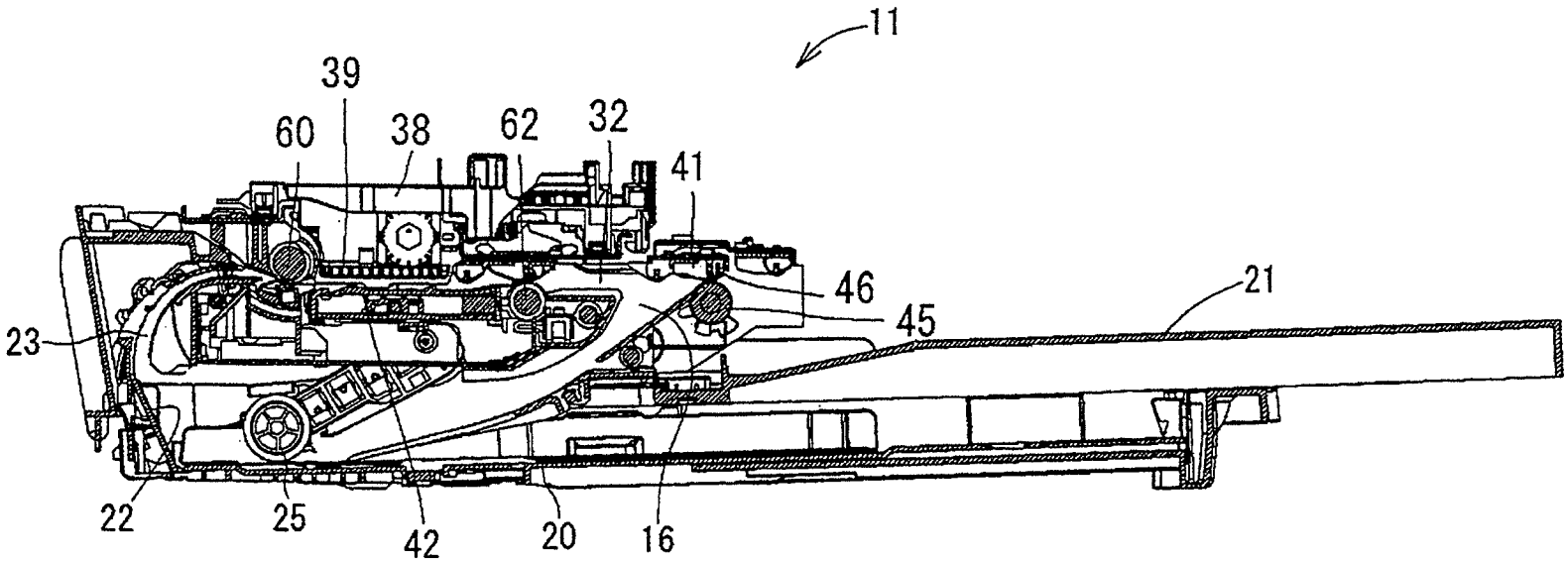
FIG. 2 is a vertical cross-sectional view of a printer of the printing device of FIG. 1.

Referring to FIG. 2, the printer 11 comprises a feed roller 25, an inclined separation plate 22, a conveying path 23, a convey roller 60, a platen 42, a printhead 39, and a discharge roller 62. The feed roller 25 is disposed on the feed tray 20. The inclined separation plate 22 stands upward from one end of the feed tray 20. The conveying path 23 extends from the inclined separation plate 22 and curves in a U-shape. The convey roller 60 is disposed on a downstream end of the conveying path 23 in a sheet conveying direction. The platen 42 is configured to support a sheet conveyed from the convey roller 60. The printhead 39 is disposed on a carriage 38 and faces the platen 42. The printhead 39 is interposed between the convey roller 60 and the discharge roller 62.

The printer 11 further comprises a first roller 45, a second roller 46, a path switching arm 41, and a reverse path 16. The first roller 45 and the second roller 46 pinch the sheet conveyed form the discharge roller 62. The path switching arm 31 extends toward an upstream side in the sheet conveying direction and is configured to support, at one end thereof, the second roller 46 rotatably, and to pivot about a rotation axis of the first roller 45. The reverse path 16 extends from the other end of the path switching arm 31 toward the feed roller 25.

In the single-sided printing mode, the feed roller 25 feeds an uppermost one of the sheets stacked on the feed tray 20 toward the inclined separation plate 22 and conveys the sheet along the conveying path 23. Then, when the convey roller 60 conveys the sheet into between the platen 42 and the printhead 39, the printhead 39 ejects ink onto a front side of the sheet to print an image thereon. The discharge roller 62, the first roller 45, and the second roller 46 discharge the sheet having the image printed on the front side onto the discharge tray 21.

In the double-sided printing mode, the printer 11 performs printing on a front side of a sheet in the same manner as in the above-described single-sided printing mode. After the printhead 39 prints an image on the front side of the sheet, a trailing edge of the sheet having the image printed on the front side is supported on a guide surface 32 while a leading edge side portion of the sheet is pinched by the first roller 45 and the second roller 46. The sheet is kept on standby in this state for a predetermined time.

The sheet is kept on standby for the predetermined time until the ink ejected onto the front side of the sheet dries. If the sheet with wet ink is conveyed, the image printed on the front side may be smeared, or the wet ink may adhere to the inside of the printer 11. The ink adhered to the inside of the printer 11 may adhere to and soil sheets conveyed subsequently.

A drying time required for an image printed on the front side of the sheet, i.e., a standby time of the sheet after an image is printed on the front side thereof and before an image is printed on the back side thereof, may be set based on the amount of ink ejected onto the front side of the sheet. The drying time increases as the amount of ink ejected onto the front side of the sheet is larger.

When the drying time, i.e., the standby time, has elapsed, the path switching arm 41 pivots from a position shown in FIG. 2 counterclockwise about the rotation axis of the first roller 45 and presses down the trailing edge of the sheet, i.e., an upstream side edge of the sheet in the sheet conveying direction. The trailing edge of the sheet, which has been supported on the guide surface 32, enters the reverse path 16.

Then, the first roller 45 and the second roller 46 are driven in a reverse direction to convey the sheet along the reverse path 16 back to the feed tray 20. The front side of the sheet contacts the feed roller 25. After that, in the same manner as in printing on the front side, the feed roller 25 feeds the sheet to the conveying path 23. After the printhead 39 prints an image on the back side of the sheet, the sheet is discharged onto the discharge tray 21.

Figure 3:
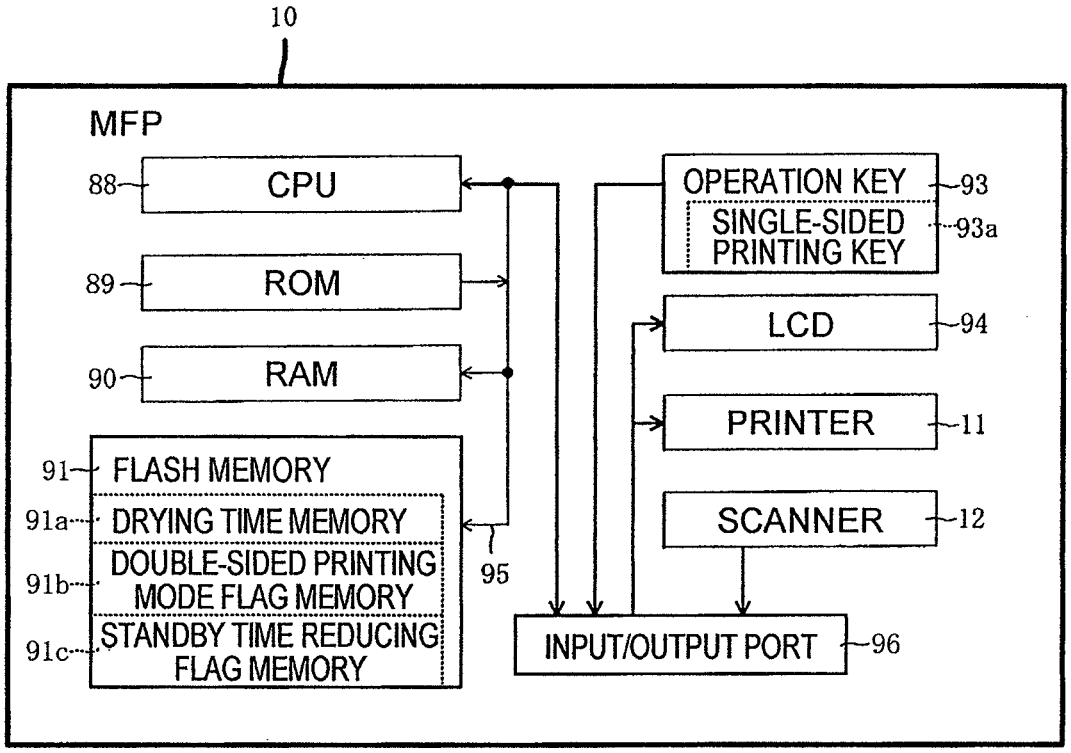
FIG. 3 is a block diagram illustrating an electrical configuration of the printing device of FIG. 1

As shown in FIG. 3, the multi-function device 10 comprises a CPU (central processing unit) 88, a ROM (read only memory) 89, a RAM (random access memory) 90, a flash memory 91, the operation keys 93, the LDC (liquid crystal display) 94, the printer 11, and the scanner 12.

The CPU 88, ROM 89, RAM 90, and flash memory 91 are connected to each other via a bus line 95. The operation keys 93, LDC 94, printer 11, scanner 12, and bus line 95 are connected to each other via an I/O (input/output) port 96.

The CPU 88 controls each function of the multi-function device 10 and each component connected to the I/O port 96, based on set values and programs stored in the ROM 89, RAM 90 and flash memory 91. The ROM 89 is an unrewritable memory and stores control programs executed in the multi-function device 10. A program for executing printing processing shown in the flowchart in FIG. 4 is stored in the ROM 89.

The RAM 90 is a rewritable volatile memory and stores various data temporarily when the multi-function device 10 is operated. The flash memory 91 is a rewritable non-volatile memory, and data stored in this memory is retained when the power of the multi-function device 10 is turned off. The flash memory 91 comprises a drying time memory 91*a*, a double-sided printing mode flag memory 91*b*, and a standby time reducing flag memory 91*c*.

Every time printing on the front side of a sheet is performed in the double-sided printing mode, the drying time memory 91*a* stores an drying time for the sheet having an image printed on the front side thereof, i.e., a standby time for the sheet after printing on the front side of the sheet is completed and before printing on the back side of the sheet is started.

The double-sided printing mode flag memory 91*b* stores a double-sided printing mode flag that indicates which of the double-sided printing mode and the single-sided printing mode is designated in the multi-function device 10. The multi-function device 10 performs printing on both sides of a sheet when the double-sided printing mode flag is on, and performs printing on one side of a sheet when the double-sided printing mode flag is off.

The double-sided printing mode flag may be set to on or off by a user from a personal computer via a printer driver. Also, the operation keys 93 may comprise a printing mode setting key such that the double-sided printing mode flag is switched on or off every time the user presses the printing mode setting key.

The standby time reducing flag memory 91*c* stores a standby time reducing flag that indicates whether to change double-sided printing to single-sided printing temporarily for a sheet having an image printed on a front side thereof when the image drying time for that sheet exceeds a predetermined time, e.g., 30 seconds, during printing in the double-sided printing mode.

The standby time reducing flag may be set to on or off by a user from the personal computer via the printer driver. Also, the operation keys 93 may comprise a standby time reducing key such that the standby time reducing flag is switched on or off every time the user presses the standby time reducing key.

If the drying time for a sheet exceeds the predetermined time, e.g., 30 seconds, when the standby time reducing flag is on, the sheet having an image printed on a front side thereof is discharged while the back side thereof is left blank. The image to be printed on the back side of the sheet is printed on the front side of a next sheet, and the next sheet having the image printed on the front side thereof is discharged.

If the drying time for a sheet exceeds the predetermined time, e.g., 30 seconds, when the standby time reducing flag is off, a notice is issued to a user, e.g., through the LCD 94. The notice asks the user whether to change from double-sided printing to single-sided printing temporarily for the sheet having an image printed on the front side thereof or to continue double-sided printing for the sheet. When the user presses the single-sided printing key 93*a* in reply to the notice, the sheet having an image printed on the front side thereof is discharged before an image is printed on the back side thereof. Subsequently, the image to be printed on the back side of the sheet is printed on the front side of a next sheet, and the next sheet having the image printed on the front side thereof is discharged.

Referring to FIG. 4, printing processing executed by the CPU 88 of the multi-function device 10 is described. The CPU 88 executes this printing processing when the double-sided printing mode is designated in the multi-function device 10 from a personal computer or the like.

The CPU 88 starts printing processing by causing the feed roller 25 to feed a sheet from the feed tray 20 in step S1. The CPU 88 determines whether the double-sided printing mode flag in the double-sided printing mode flag memory 91*b* is on in step S2. When the CPU 88 determines that the double-sided printing mode flag is off in step S2, which means that the single-sided printing mode is designated in the multi-function device 10, the CPU 88 controls the printhead 39 to print on the front side of the sheet an image corresponding to one page of image data in step S3. Then, the processing goes to step S17.

When the CPU 88 determines that the double-sided printing mode flag is on in step S2, the CPU 88 initializes the drying time memory 91*a* in step S4, and controls the printhead 39 to print on the front side of the sheet a front-side image corresponding to one page of image data in step S5. Then, the CPU calculates the drying time for the front-side image printed on the front side of the sheet based on the amount of ink ejected onto the front side of the sheet and stores the calculated drying time in the drying time memory 91*a* in step S6.

The drying time may be calculated by estimating the amount of ink necessary to print a front-side image, based on the amount of image data and the contents of image data. In this case, however, the burden and time required for the CPU 88 to calculate increases as the amount of image data increases.

When the drying time is calculated based on the amount of ink actually used to print a front-side image, the drying time is obtained accurately. The amount of ink actually used may be calculated based on the number of droplets ejected to the sheet and the volume of each ejected droplet. In this case, the sheet having a font-side image printed on the front side thereof is prevented from being kept in a standby state for a longer time than necessary before printing on the back side is started. The drying time increases as the amount of ink ejected onto the front side of the sheet increases.

The CPU 88 determines whether the drying time stored in the drying time memory 91*a* exceeds 30 seconds in step S7. when the CPU 88 determines that the drying time does not exceed 30 seconds in step S7, the processing goes to step S14. In step S14, the sheet having the front-side image is kept in a standby state until the drying time elapses. When the CPU 88 determines that the drying time exceeds 30 seconds in step S7, the CPU 88 determines whether the standby time reducing flag in the standby time reducing flag memory 91*c* is on in step S8.

When the CPU 88 determines that the standby time reducing flag is off in step S8, a notice is issued e.g., to the LCD 94 in step S9. The CPU 88 controls the LCD 94 to display a notice saying "The printer is now operating in the double-sided printing mode. At least 30 seconds of standby time is necessary to dry the front side of this sheet. Please press the single-sided printing key if you prefer single-sided printing for this sheet?"

The CPU 88 determines whether the single-sided printing key 93*a* is pressed in step S10. When the CPU 88 determines, in steps S10 and S10A, that the single-sided printing key 93*a* is not pressed before the drying time elapses, the processing goes to step S15. In step S15, the sheet is guided by the path switching arm 41 to the reverse path 16, and is fed by the feed roller 25 toward the printhead 39 while being flipped over. The printhead 39 prints on the flipped-over sheet a back-side image corresponding to subsequent one page of image data in step S16, and the processing goes to step S17.

When the CPU 88 determines that the single-sided printing key 93*a* is pressed in step S10, the processing goes to step S11. In steps S11-S13, as described later, single-sided printing is temporarily performed, and a back-side image to be printed on the back side of the sheet, which has the front-side image, is printed on the front side of another sheet. In other words, the sheet having the front-side image is discharged while the back side thereof is left blank, and a back-side image is printed on the front side of a next sheet, instead of being printed on the back side of the sheet having the front-side image.

When the CPU 88 determines that the standby time reducing flag is on in step S8, the processing skips steps S9 and S10 and goes to step S11 without waiting an instruction from the user. In steps S11, a notice saying "Single-sided printing is temporarily selected." is issued e.g., to the LCD94. In step S12, the sheet having the front-side image is discharged onto the discharge tray 21 before the drying time elapses, and without a back-side image being printed on the back side thereof.

Because the sheet kept in a standby state is discharged, instead of being conveyed to the feed roller 25, the wet ink on the front side of the sheet is prevented from adhering to the feed roller 25. Thus, a next sheet conveyed by the feed roller 25 is prevented from being soiled by the ink adhered to the feed roller 25, and the quality of image is maintained.

In step S13, the CPU 88 controls the feed roller 25 to feed a next sheet from the feed tray 20 and controls the printhead 39 to print the back-side image corresponding to subsequent one page of image data on the front side of the next sheet.

In step S17, the CPU 88 controls the first roller 45 and the second roller 46 to discharge the sheet having an image on one side or on both sides thereof onto the discharge tray 21. The CPU 88 determines whether images corresponding to all pages of image data are printed on respective sheets in step S18. When the result of step S18 is affirmative, i.e., "Yes" in step S18, the processing is completed.

When the result of step S18 is negative, i.e., "No" in step S18, the processing returns to step S1, and the CPU 88 controls the printer 11 to print an image corresponding to subsequent one page of image data on a next sheet. The processing returns to step S1 repeatedly until printing of all pages of image data is completed.

According to the printing processing shown in FIG. 4, when the drying time exceeds 30 seconds during printing on the double-sided printing mode, double-sided printing is temporarily changed to single-sided printing such that a back-side image to be printed on the back side of a sheet having a front-side image is printed on the front side of a next sheet. In this case, there is no need for the sheet having the front-side image to be kept on standby until the drying time elapses. This may reduce the waiting time for the user until printing on the double-sided printing mode is completed.

When the standby time reducing flag is on, and when the drying time exceeds 30 seconds during printing on the double-sided printing mode, double-sided printing is automatically changed to single-sided printing. This saves the user from the trouble of giving an instruction as to whether to change double-sided printing to single-sided printing. Also, this may reduce the waiting time for the user until printing on the double-sided printing mode is completed.

On the other hand, when the standby time reducing flag is off, a notice that asks the user whether to change double-sided printing to single-sided printing or to continue double-sided printing is issued every time the drying time exceeds 30 seconds. This allows the user to select double-sided printing or single-sided printing as desired and to recognize a temporary change of the printing mode. Also, this may reduce the waiting time for the user until printing on the double-sided printing mode is completed.

In the above-described embodiment, a back-side image is printed on the front side of a next sheet based on whether the drying time exceeds 30 seconds on the double-sided printing mode. However, 30 seconds is an exemplary threshold value and other threshold values may be used. In addition, the multi-function device 10 may be configured such that the threshold value for the drying time is arbitrarily set by the user.

In steps S9 and S11 of the above-described printing processing, a notice about a changeover from double-sided printing to single-sided printing is displayed on the LCD 94. In another embodiment, a notice may be displayed, via a printer driver, on a displaying device. e.g., a monitor, which is connected to an external device, e.g., a personal computer. In yet another embodiment, the multi-function device 10 may be configured to comprise a speaker, and a notice may be issued auditorily.

In another embodiment, as shown in FIG. 5, step S10B may be added as a next step of S10 of the printing processing shown in FIG. 4. When the single-sided printing key 93*a* is pressed by the user in reply to a notice as to whether to temporarily change double-sided printing to single-sided printing in S10, the CPU 88 turns off the double-sided printing mode flag in step S10B. A sheet having a front-side image is discharged in S12, a back-side image is printed on a next sheet in step S13, and the next sheet having the back-side image is discharged in step S17. When the CPU 88 determines that there are remaining pages of image data to be printed, i.e., "No" in step S18, the processing returns to S1 where a next sheet is fed. In step S2, the CPU 88 determines that the double-side printing flag is on, and after that, printing is performed on the single-sided printing mode. Thus, once the single-sided printing key 93*a* is pressed during printing on the double-sided printing mode, printing is performed in the single-sided printing mode for sheets fed subsequent to the discharge of the next sheet having the back-side image.

In the above described embodiments, steps S1-S18 is performed by a program executed by the CPU 88 of the multi-function device 10. Nevertheless, in another embodiment, these steps may be carried out by a different portion of the multi-function device 10, or by software, e.g., a computer program product configured to be stored on a computer readable medium, and comprising instructions for causing a processor to execute the above-described steps.

While the invention has been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the following claims.

What is claimed is:

1. A printing device configured to operate selectively in one of a single-sided printing mode for printing on one side of a sheet and a double-sided printing mode for printing on both sides of a sheet, the printing device comprising:

a printing unit configured to eject ink;

a convey roller;

a discharge tray; and a controller, wherein when the printing device operates in the double-sided printing mode, the controller is configured to:

calculate a drying time of a front-side image for a front side of a sheet, determine whether the calculated drying time exceeds a predetermined threshold value, when the controller determines that the calculated drying time does not exceed the predetermined threshold value, control the printing unit to wait until after the calculated drying time elapses to print a back-side image on a back side of the sheet after the printing unit prints the front-side image on the front side of the sheet;

when the controller determines that the calculated drying time exceeds the predetermined threshold value, control the convey roller to discharge the sheet having the front-side image printed on the first side thereof onto the discharge tray after the printing unit prints the front-side image on the front side of the sheet without waiting for the calculated drying time to elapse, and when the controller determines that the calculated drying time exceeds the predetermined threshold value, control the printing unit to print the back-side image on a next sheet.

2. The printing device according to claim 1, wherein the controller is configured to calculate the drying time of the front-side image for the front side of the sheet based on an amount of ink ejected by the printing unit onto the front side of the sheet.

3. The printing device according to claim 1, wherein when the printing device operates in the double-sided printing mode and sequentially performs printing on a plurality of sheets, the controller is configured to calculate the drying time of a front-side image for a front side of each sheet.

4. The printing device according to claim 1, wherein when the printing device operates in the double-sided printing mode, the controller is further configured to:

when the controller determines that the calculated drying time exceeds the predetermined threshold value, issue a notice requesting an instruction to be input into the printing device and determine, based on the inputted instruction, whether the back-side image is to be printed on the next sheet, and control the printing unit to print the back-side image on the next sheet when the controller determines that the back-side image is to be printed on the next sheet.

5. The printing device according to claim 4, wherein when the printing device operates in the double-sided printing mode and sequentially performs printing on a plurality of sheets, the controller is configured to calculate the drying time of a front-side image for a front side of each sheet, and to issue the notice requesting an inputted instruction each time the controller determines that the calculated drying time exceeds the predetermined threshold value.

6. The printing device according to claim 4, wherein when the printing device does not receive the inputted instruction that the back-side image is to be printed on the next sheet within a predetermined time equal to the drying time, the controller is configured to control the printing unit to print the back-side image on the back side of the sheet after the printing unit prints the front-side image on the front side of the sheet.

7. The printing device according to claim 4, wherein when the printing device operates in the double-sided printing mode and sequentially performs printing on a plurality of sheets, when the printing device receives the inputted instruction that the back-side image is to be printed on the next sheet, the controller is configured to withhold further issuing the notice until the printing device completes printing the plurality of sheets.

8. The printing device according to claim 7, wherein when the printing device operates in the double-sided printing mode and sequentially performs printing on the plurality of sheets, when the printing device receives the inputted instruction that the back-sided image is to be printed on the next sheet, the controller is configured to control the printing device to transition from the double-sided printing mode to the single-sided printing mode, such that the printing unit prints on one side of each sheet after the printing device receives the inputted instruction.

9. The printing device according to claim 4, further comprising a display, wherein the controller is configured to display the notice on the display.

10. The printing device according to claim 1, further comprising:

a feed tray configured to store sheets; and a feed roller configured to feed the sheets one by one from the feed tray toward the printing unit in a sheet conveying direction, wherein the convey roller is disposed downstream of the printing unit in the sheet conveying direction and is configured to rotate selectively in a first direction and in a second direction opposite to the first direction, and wherein, when the controller determines that the calculated drying time exceeds the predetermined threshold value, the controller is configured to control the convey roller to rotate in the first direction, such that the sheet having the front-side image is discharged onto the discharge tray.

11. The printing device according to claim 10, wherein when the controller determines that the calculated drying time does not exceed the predetermined threshold value, the controller is configured to wait until after the calculated drying time elapses to control the convey roller to rotate in the second direction, such that the sheet having the front-side image is not conveyed to the feed tray until after the calculated drying time elapses.

12. The printing device according to claim 1, wherein, when it is determined that the calculated drying time exceeds the predetermined threshold value, the controller is configured to control the printing unit to print the back-side image on a front side of the next sheet.

13. The printing device according to claim 12, wherein the controller is further configured to control the convey roller to discharge the next sheet having the back-side image printed on the front side thereof onto the discharge tray, while leaving a back side of the next sheet thereof blank.

14. A non-transitory computer-readable recording medium for use in a printing device and storing computer readable instructions, the computer readable instructions being configured to be executed by a processor to cause the printing device to perform the steps of:

determining whether a double-sided printing mode for printing on both sides of a sheet is designated for the printing device;

calculating a drying time of a front-side image printed on the front side of the sheet when it is determined that the double-sided printing mode is designated;

determining whether the calculated drying time exceeds a predetermined threshold value;

when it is determined that the calculated drying time does not exceed the predetermined threshold value, waiting until after the calculated drying time elapses to print a back-side image on a back side of the sheet after printing the front-side image on the front side of the sheet;

when it is determined that the calculated drying time exceeds the predetermined threshold value, discharging the sheet having the front-side image printed on the front side thereof after printing the front-side image on the front side of the sheet without waiting for the calculated drying time to elapse; and when it is determined that the calculated drying time exceeds the predetermined threshold value, printing the back-side image on a next sheet.

15. The non-transitory computer-readable recording medium according to claim 14, wherein the computer readable instructions are configured to be executed by the processor to cause the printing device to further perform the steps of:

issuing a notice requesting an instruction to be inputted into the printing device and determining, based on the inputted instruction, whether to print the back-side image on the next sheet;

printing the back-side image on the next sheet, when it is determined that the back-side image is to be printed on the next sheet.

* * * * *